US006454642B1

(12) United States Patent
Fierus et al.

(10) Patent No.: US 6,454,642 B1
(45) Date of Patent: Sep. 24, 2002

(54) DEVICE FOR SHARPENING KNIVES, SCISSORS OR OTHER CUTTING TOOLS

(75) Inventors: Udo Fierus, Leverkusen; Gerd Fierus, Odenthal-Blecher, both of (DE)

(73) Assignee: Flugel CSS GmbH & Co. KG (DE)

( * ) Notice: Subject to any disclaimer, the term of this patent is extended or adjusted under 35 U.S.C. 154(b) by 0 days.

(21) Appl. No.: 09/601,055

(22) PCT Filed: Nov. 20, 1999

(86) PCT No.: PCT/EP99/08974

§ 371 (c)(1),
(2), (4) Date: Sep. 25, 2000

(87) PCT Pub. No.: WO00/30811

PCT Pub. Date: Jun. 2, 2000

(30) Foreign Application Priority Data

Nov. 25, 1998 (DE) ..... 198 54 496

(51) Int. Cl.[7] ..... B24D 17/00
(52) U.S. Cl. ..... 451/519; 451/552

(58) Field of Search ..... 451/514, 518, 451/519, 520, 490, 552, 556, 45; 76/82, 82.2, 88, 89.1, 89.2

(56) References Cited

U.S. PATENT DOCUMENTS 2,241,412 A * 5/1941 Meade et al. ..... 51/214
4,759,153 A * 7/1988 Cohen ..... 51/211 R
5,976,002 A * 11/1999 Keough ..... 451/556

* cited by examiner

*Primary Examiner*—Timothy V. Eley
*Assistant Examiner*—Dung Van Nguyen
(74) *Attorney, Agent, or Firm*—Cantor Colburn LLP

(57) ABSTRACT

The invention relates to a device for sharpening knives, scissors or other cutting tools with at least on abrasive grinding element which is arranged in a housing pushing against a resilient force. The aim of the invention is to provide a device that is simple in its design and that is characterized by its versatility. To this end, the grinding element is configured as a strip structure and is arranged on blade-shaped support which in turn is resiliently guided along the housing.

12 Claims, 8 Drawing Sheets

DEVICE FOR SHARPENING KNIVES, SCISSORS OR OTHER CUTTING TOOLS

TECHNICAL FIELD

The invention concerns a device for sharpening knives, shears or similar cutting tools with at least one abrasive sharpening element which is located in a housing withdrawing against spring force.

BACKGROUND OF THE INVENTION

Devices for sharpening knives, shears, or similar cutting tools are known in very different designs. In addition to ceramic sharpening disks and sharpening stones, sharpening steels are used in particular for knife sharpening, and indeed, also in the home. Since, in particular, the sharpening of knives with sharpening stones or sharpening steels requires a certain manual skill, special knife sharpeners, which primarily are used in private homes, also have been developed.

DE 38 33 065 C2 discloses a knife sharpener which includes two sharpening pieces in the form of sharpening disks mounted capable of turning, parallel and offset from one another, in a plastic housing, which disks can draw back spring-mounted. The knife cutting edge to be sharpened is inserted from above into the slot formed by the circular sharpening pieces transverse to the length of the housing and moves with the application of a pressure force relative to the sharpening pieces.

Although such knife sharpeners have proved themselves in practice, they have the disadvantage that they are suited only for keeping knives sharp by regular sharpening. Dull knives, the cutting edge of which has become too thick as a result of insufficient resharpening and incorrect handling, can be restored to the functional condition (sharpness) only with considerable expenditure of time, or in part can no longer be restored.

SUMMARY OF THE INVENTION

The object of the invention is to cremate a sharpening device of the type mentioned above, which makes a simple sharpening of knives, shears, or similar cutting tools possible with avoiding the above-mentioned disadvantages, in particular if these cutting tools have a cutting edge deviating from a straight edge.

The achievement of this object by means of the invention is characterized by the fact that the sharpening element is made in the shape of a strip and is located on a blade-shaped carrier which for its part is guided spring-mounted on the housing.

The strip-shaped design of the sharpening element and the arrangement thereof on a strip-shaped carrier guided spring-mounted on the housing produces the possibility of guiding the cutting edge of the cutting tool at the desired sharpening angle relative to the sharpening element, the motion including components passing both in the longitudinal direction of the sharpening element and also transverse to this. Because of the spring-mounted guiding of the sharpening element on the housing, the sharpening element is in a position to draw back within limits, so that the sharpening surface matches the existing cutting geometry of the cutting tool. In this way cutting tools also can be sharpened reliably with a cutting edge deviating from a straight line, in particular of a concavely or convexly curved cutting edge—also with a curvature changing along the cutting edge.

According to a further feature of the invention the blade-shaped carrier is guided spring-mounted at least on its ends, in each case via a spring on the housing, which results in a particularly simple construction.

According to a further development of the invention, in each case the blade-shaped carrier can be made as a part molded on one end of the strip-shaped sharpening element, which part is guided spring-mounted in the housing in each case via a spring. This design results in a particularly simple configuration.

In the case of an alternative embodiment of the invention, the blade-shaped carrier is mounted on the housing and made as a spring element. In the case of this design there are no additional springs, so that the number of components is reduced.

Independent of the configuration of the carrier, the invention also proposes making the working surface of the strip-shaped sharpening element convex transverse to its length. This produces a better adjustment of the working surface of the sharpening element to a cutting element deviating from a straight line.

In the case of a preferred embodiment of the device according to the invention, several sharpening elements are guided spring-mounted on the housing parallel to and separated from each other in each case via a carrier. A number of sharpening elements of this kind shortens the time expenditure required for sharpening a cutting tool, without hindering the possibility of adjusting the individual sharpening elements to the cutting edge geometry in each case, since each sharpening element is guided spring-mounted on the housing independent of the others.

If cutting tools also are to be sharpened with a so-called cylindrical grinding with the device according to the invention, according to a further feature of the invention the working surfaces are made corresponding in cross-section to the cylindrical grinding of the respective cutting edge. The spring-mounted sharpening elements also make it possible to move this cutting edge geometry transverse to the longitudinal axis of the sharpening elements.

Further with the invention it is proposed to mount each strip-shaped sharpening element with its ends in each case on a tongue-shaped carrier and to combine several tongue-shaped carrier into one carrier unit, which can be installed in the housing as a component. This results in the possibility of creating an assembly including the cutting elements which can be used in housings of different designs.

In the case of a further development the carrier unit is mounted capable of turning on a base plate, which in each case is provided with guides for the free ends of the tongue-shaped carrier, in order to avoid buckling or other damage to the latter.

In order to improve the mobility of the sharpening elements for the purpose of adapting to the respective cutting edge geometry of the cutting tool to be sharpened, the sharpening elements in each case can be made elastically springmounted between their ends in each case mounted on a tongue-shaped carrier. In this case the elasticity of the sharpening elements is added to the elastic properties of the tongue-shaped carrier.

In order to prevent damage to the sharpening elements on the basis of their elastic deformation, the elastic deformation of the sharpening elements can be limited in each case by a stop. This stop preferably is made in the middle of the carrier unit.

Altogether the invention results in a device for sharpening cutting tools of this kind, which makes a reliable sharpening of cutting tools possible in spite of its simply and inexpensively made construction, even if these cutting tools have a cutting edge geometry deviating from a straight line.

BRIEF DESCRIPTION OF THE DRAWINGS

Several embodiments of the device according to the invention are shown in the drawing; here

DETAILED DESCRIPTION OF THE PREFERRED EMBODIMENT

Figure 2:
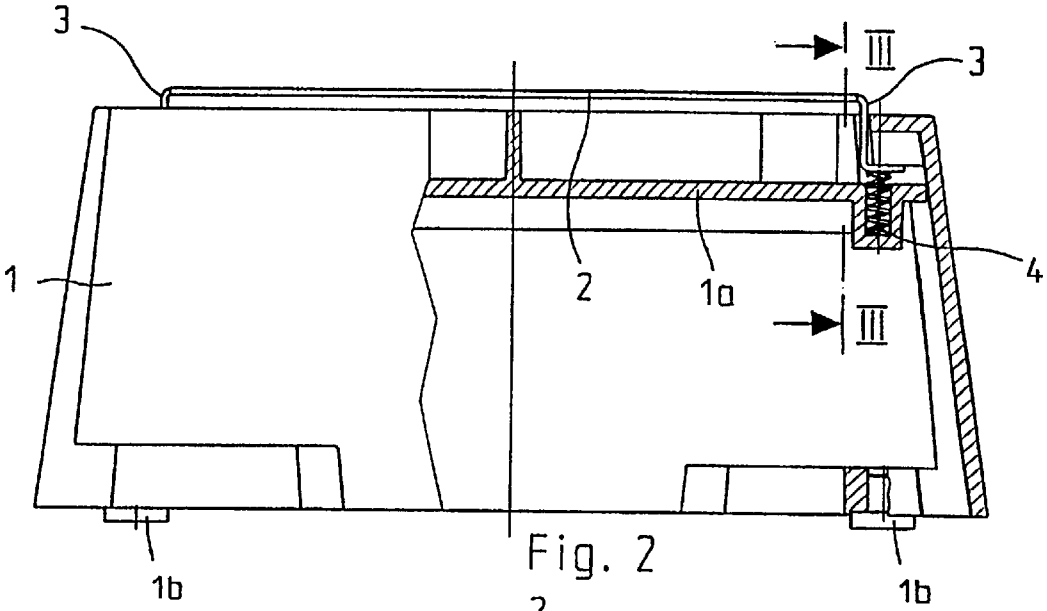
FIG. 2 shows a side view of the embodiment according to FIG. 1 shown partially in a longitudinal section.
Figure 4:
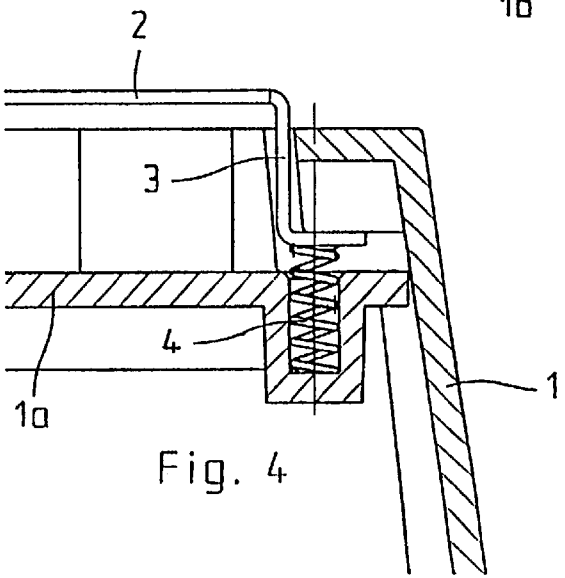
FIG. 4 shows a partial section of the upper right corner in FIG. 2 shown magnified.
Figure 1:
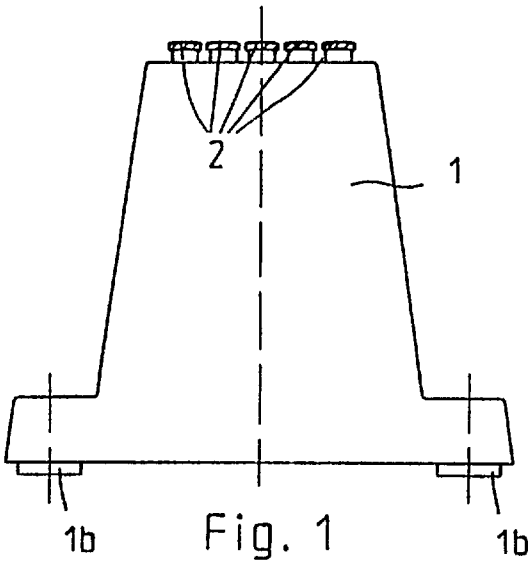
FIG. 1 shows a front view of a first embodiment.

The first specific embodiment of the sharpening device shown in FIGS. 1 to 6 includes a housing 1, in which several strip-shaped sharpening elements 2 are spring-mounted parallel to and at a distance from one another. Each sharpening element 2 is mounted on a blade-shaped carrier 2, which in the case of the specific embodiment in each case is molded on one end of the strip-like sharpening element 2. Over this blade-shaped carrier 3 each sharpening element 2 is supported on its ends on the housing 1 in each case via a spring 4. In the case of the specific embodiment according to FIGS. 1 to 4, this support takes place via a an inner part 1 a mounted on the housing 1. In order to avoid slipping of the housing 1 during the sharpening process, the housing 1, respectively the inner part 1*a* thereof, is provided with four feet 1*b*, which are provided with a non-skid bearing surface.

Figure 3:
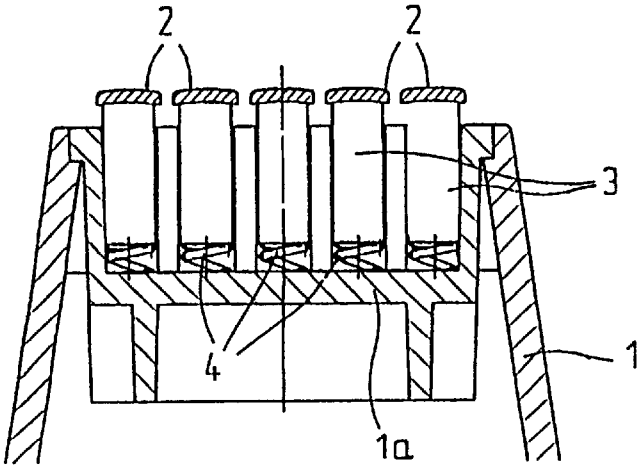
FIG. 3 shows a cross-section along the lined II—II in FIG. 2 shown magnified.
Figure 5:
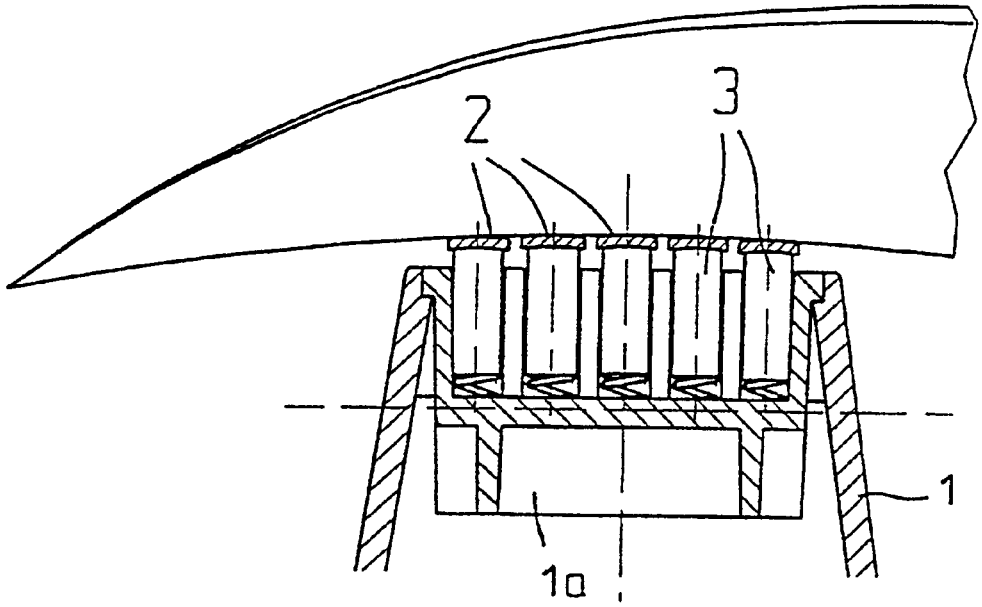
FIG. 5 shows the operating principle of the device by means of the representation according to FIG. 3 in the case of sharpening a knife with a concavely curved cutting edge.
Figure 6:
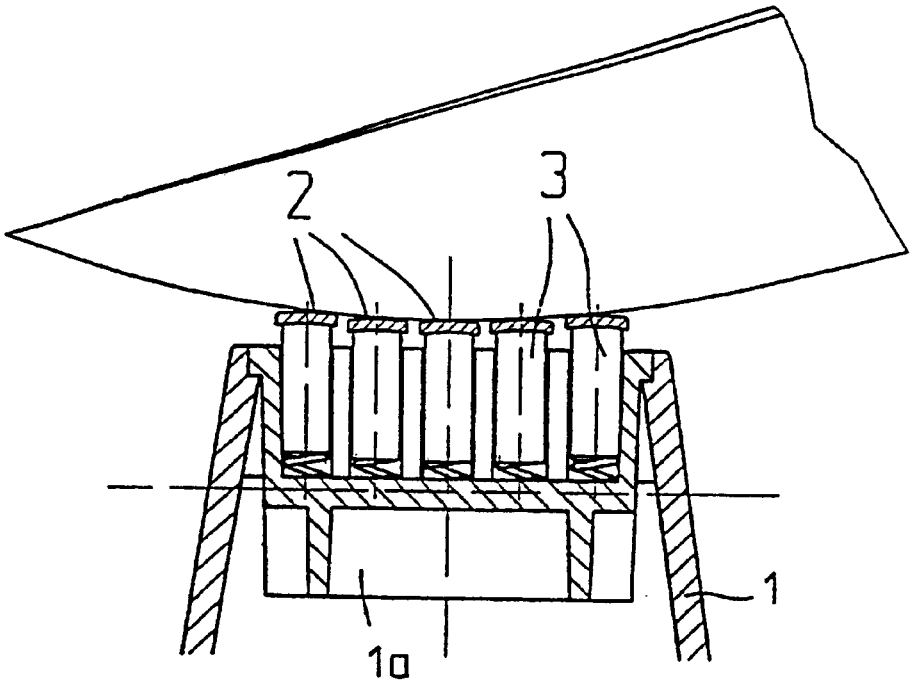
FIG. 6 shows a representation according to FIG. 5 in the case of sharpening a knife with a convexly curved cutting edge.

As FIGS. 5 and 6 show, analogous to FIG. 3, in the case of sharpening a knife, the sharpening elements 2 in each case made with a convex working surface because of their individual spring mounting are in a position to adjust to different contours of the cutting edge geometry deviating from a straight line. FIG. 5 shows the sharpening of a knife blade with concave cutting edge geometry, while a knife blade with convex cutting edge geometry is shown in FIG. 6.

Figure 7:
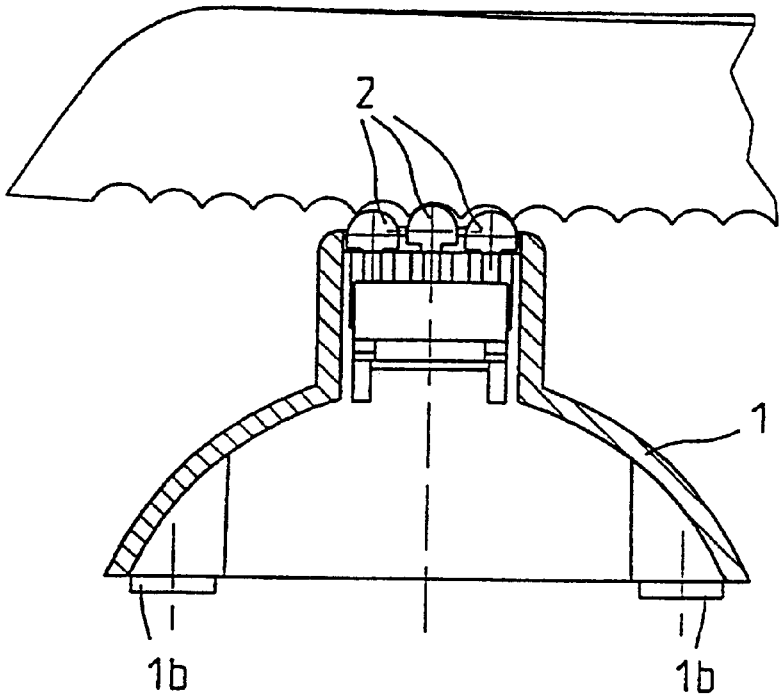
FIG. 7 shows a further representation of the operating principle corresponding to FIG. 5 and 6 in the case of sharpening a knife with a cylindrical grinding with the use of a second embodiment of the device.
Figure 8:
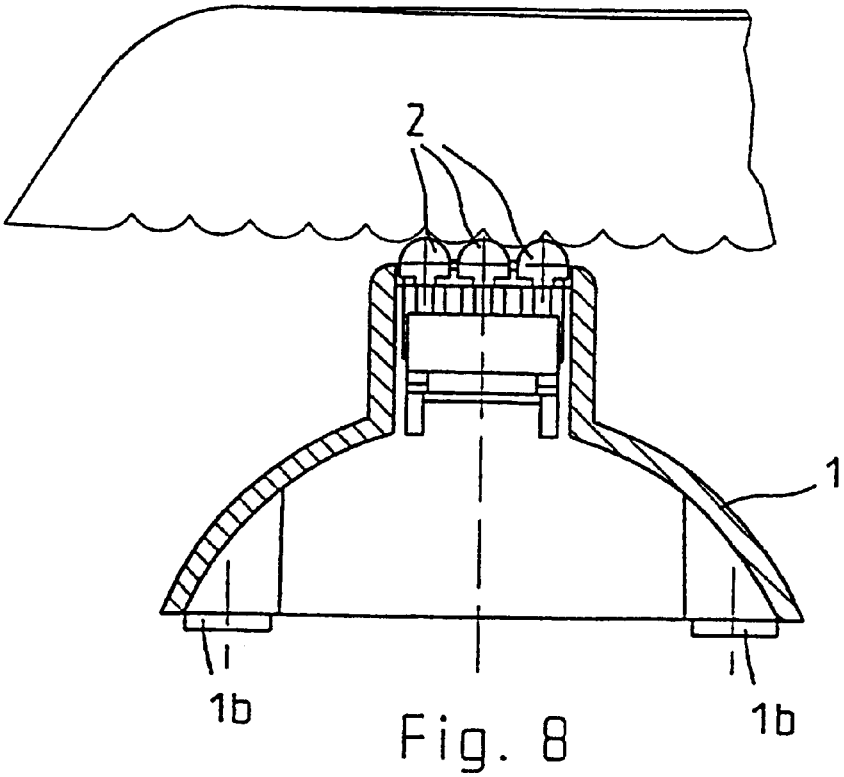
FIG. 8 shows a representation corresponding to FIG. 7 in the case of sharpening a knife with modified cylindrical grinding.

FIGS. 7 and 8 show the sharpening of knife blades with a cylindrical contour of the cutting edge, and with the use of devices which are described below. In the case of the devices shown in FIGS. 7 and 8 the sharpening elements 2 have a contour adapted to the wave shape of the cutting edge.

Figure 10:
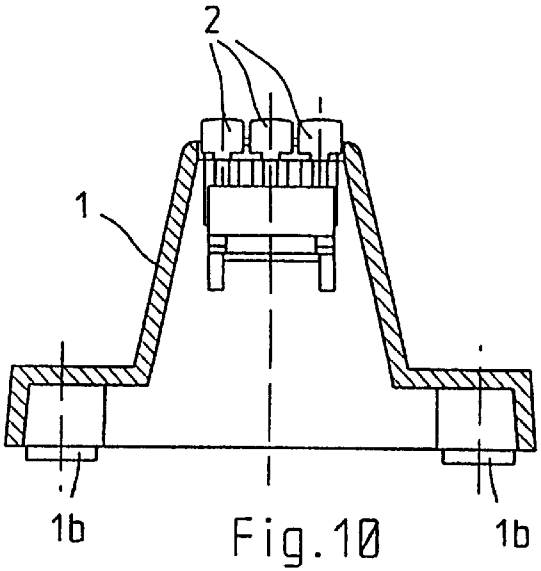
FIG. 10 shows a cross-section along the line X—X in FIG. 9.
Figure 9:
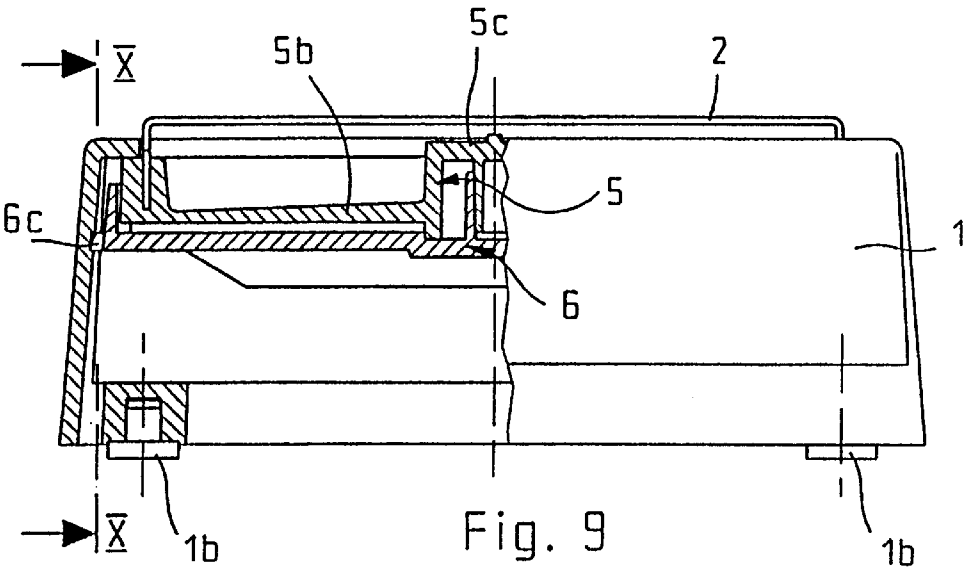
FIG. 9 shows a side view of a third embodiment of the device, shown partially in a longitudinal section.
Figure 11:
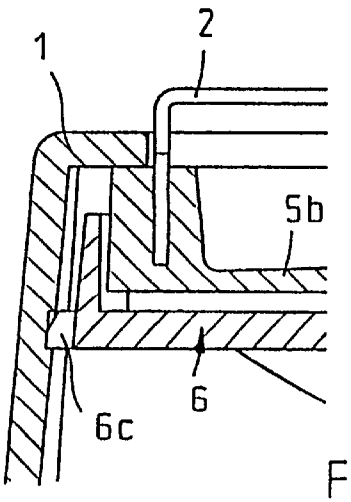
FIG. 11 shows a magnified representation of the upper left corner of FIG. 9.

FIGS. 9 to 11 show a second embodiment of the device, which again includes a housing 1 provided with feet 1*b*. A carrier unit 5 is inserted into this housing 1 by means of a base plate. The carrier unit 5 holding three sharpening elements 2 in the case of the specific embodiment together with the base plate 6 forms an assembly which can be used according to FIGS. 10 and 12 in differently designed housings 1 in a simple way.

Figure 15:
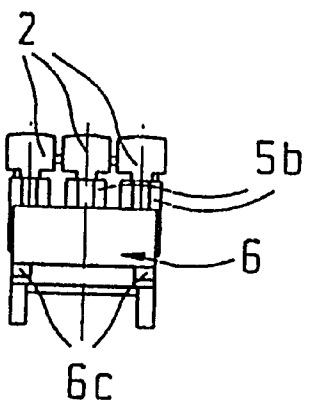
FIG. 15 shows a front view of FIG. 13.
Figure 13:
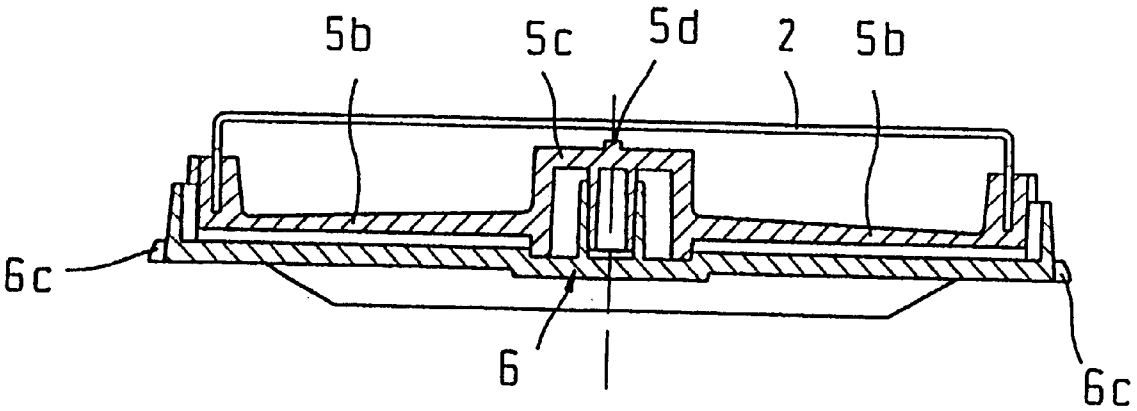
FIG. 13 shows a longitudinal section through the assembly according to FIGS. 9 to 12 containing the sharpening elements.
Figure 14:
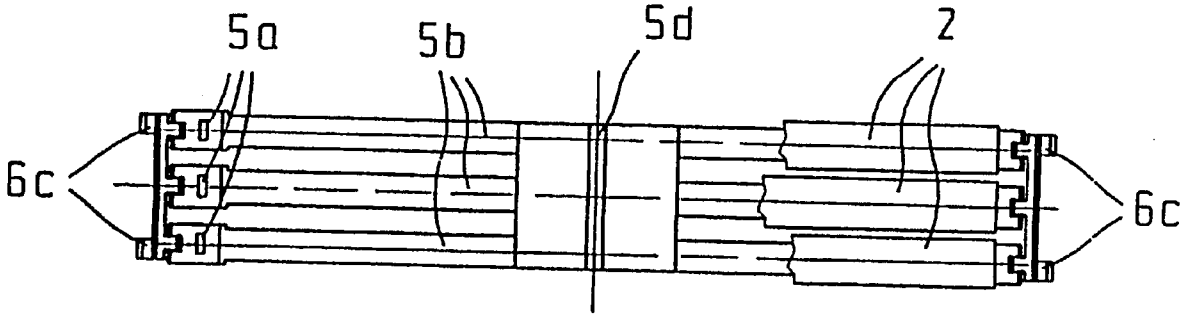
FIG. 14 shows a top view of FIG. 13.

The construction of this component is shown in FIGS. 13 to 15; FIGS. 16*a* to 18*c* show the details.

Figure 16C:
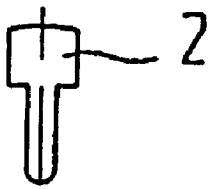
FIG. 16*c* shows a front view of a sharpening element used according to FIG. 13.
Figure 16A:
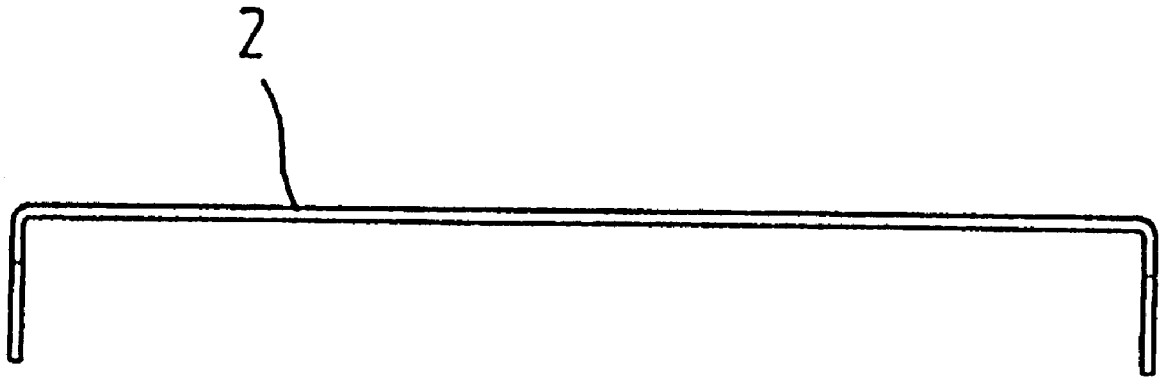
FIG. 16*a* shows a side view.
Figure 16B:
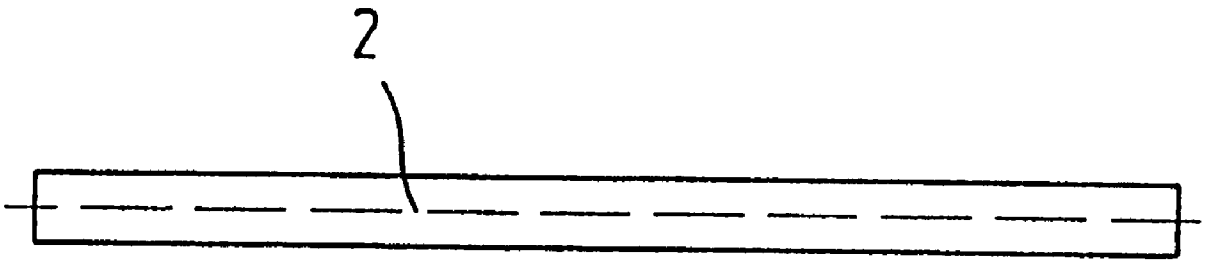
FIG. 16*b* shows a top view.
Figure 17C:
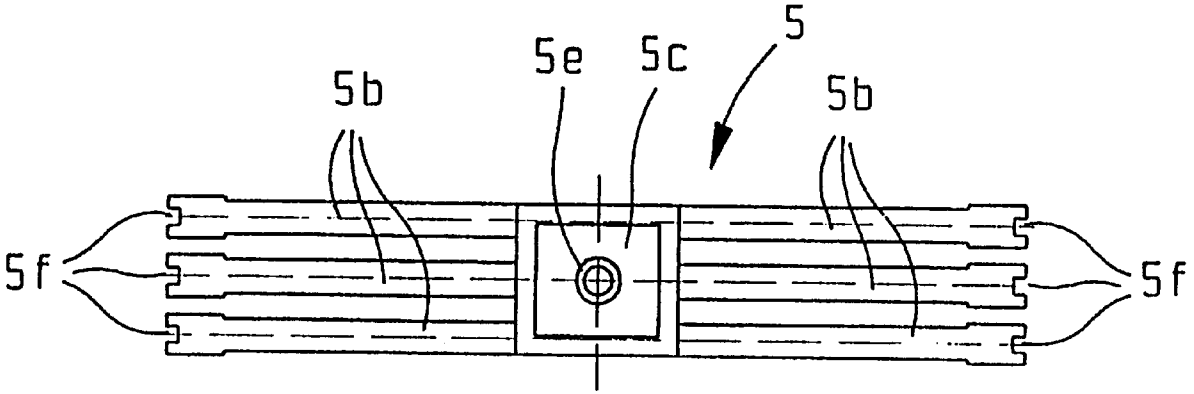
FIG. 17*c* shows a view from below of the carrier unit used in FIG. 13.
Figure 17A:
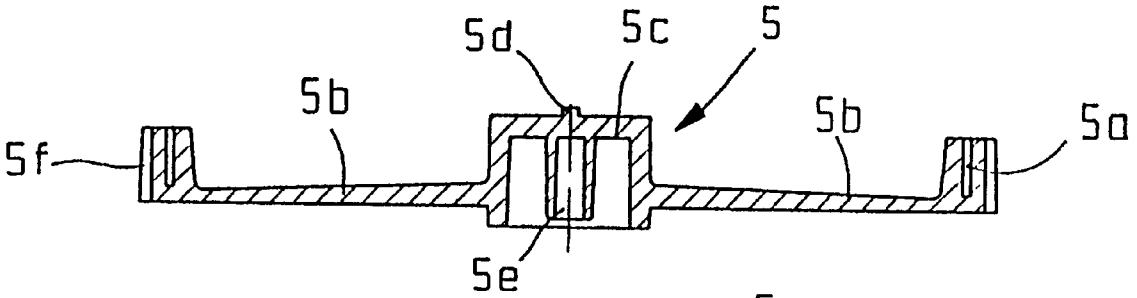
FIG. 17*a* shows a longitudinal section.
Figure 17B:
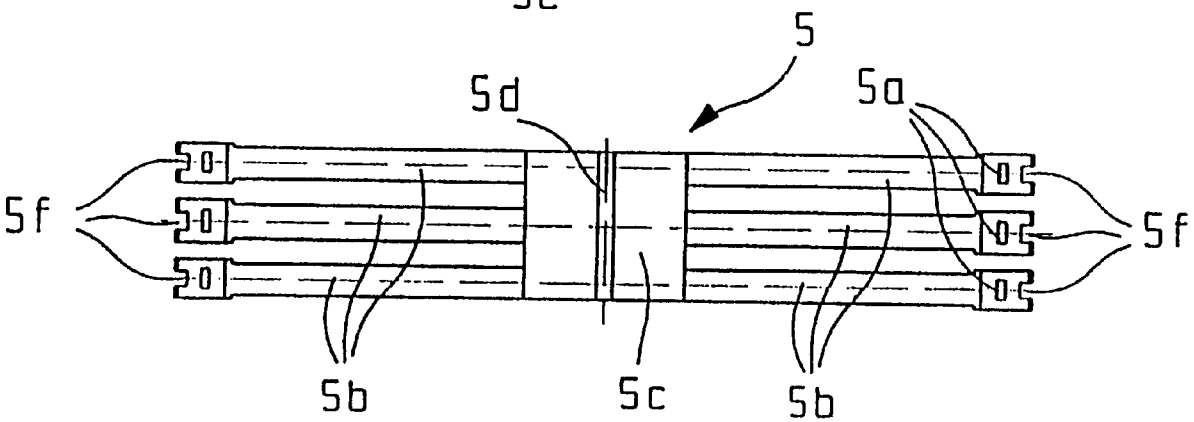
FIG. 17*b* shows a top view.

As follows from FIGS. 16*a*, and 16*c*, in the case of this embodiment cutting elements 2, the working surface of which is made convex, and which are bent down at a right angle on theirs ends, are used. With these bent-down ends the sharpening elements 2 are inserted into corresponding recesses 5*a* of tongue shaped carriers 5*b*, which project from a middle piece 5*c* and thus form a carrier unit 5. Each tongue-shaped carrier 5*b* can move with spring-mounted respect to the middle piece 5*c* because of its shaping. In addition, an elastic spring capacity of each individual sharpening element 2, results form the mounting of the sharpening elements 2 on the tongue-shaped carriers 5*b* of the carrier unit 5, as follows in particular from FIG. 13. In order to limit the elastic spring action of the sharpening elements 2, the middle piece 5*c* of the carrier unit 5 is provided with a stop surface 5*d* running transverse to the sharpening elements 2.

Figure 18C:
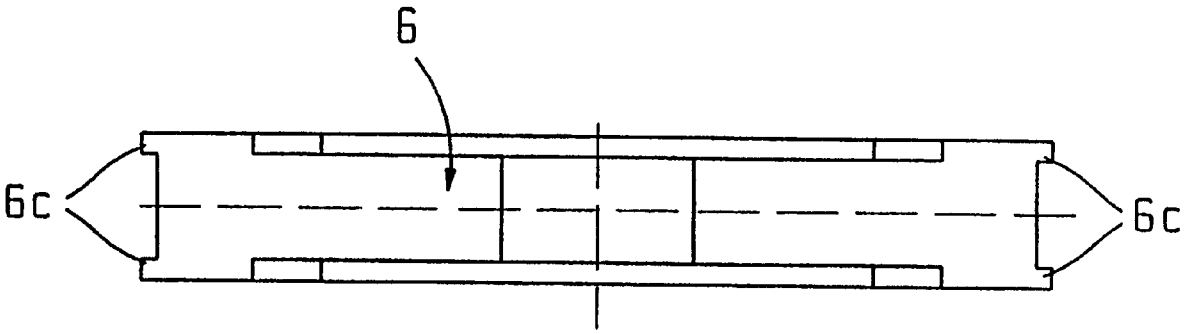
FIG. 18*c* shows a view from below of the base plate shown in FIG. 13.
Figure 18A:
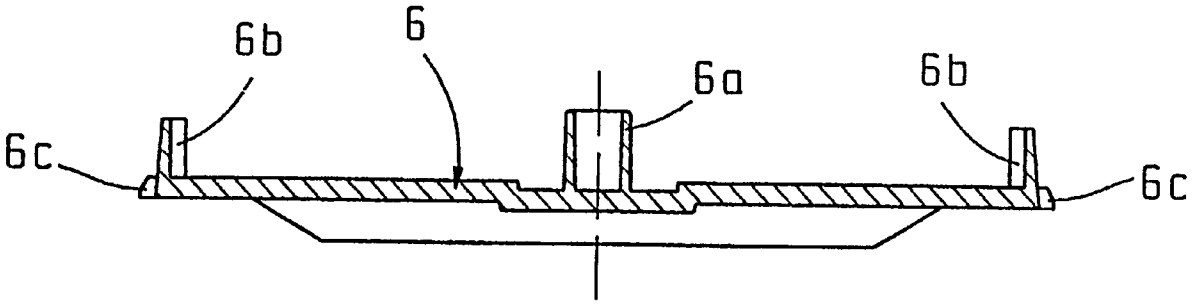
FIG. 18*a* shows a longitudinal section.
Figure 18B:
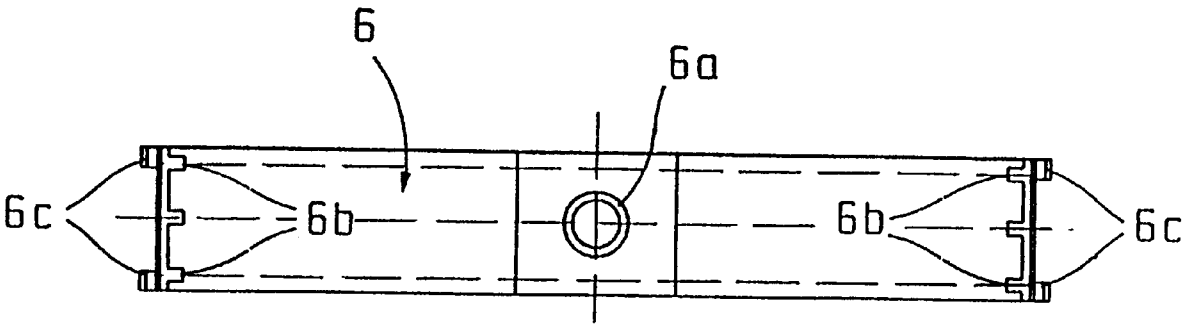
FIG. 18*b* shows a top view.

As follows in particular from FIG. 13, the entire carrier unit 5 is mounted on a base plate 6, which is shown as an individual part in FIGS. 18*a* to 18*c*. The base plate 6 includes a hollow pin 6*a* projecting from its upper side, into which a pin 5*e* located in the middle piece 5*c* of the carrier unit 5 engages. In order to prevent an undesirable turning of the carrier unit 5 relative to the base plate 6, the base plate 6 is provided with guide bars 6*b* on which the free ends of the carriers 5*b*, which are made with guide grooves 5*f* for this purpose, are guided in the vertical direction.

Figure 12:
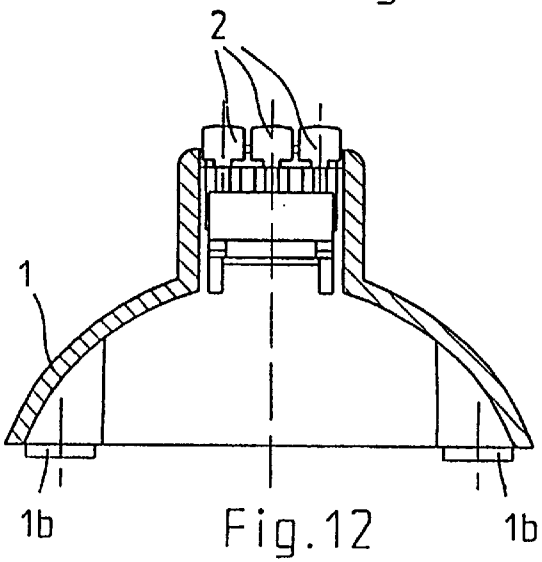
FIG. 12 shows a cross-section corresponding to FIG. 10 in the case of using a modified housing.

Finally, the base plate 6 possesses detents 6*c*, by means of which the component is inserted into a housing 1, as FIGS. 9 and 11 show. By means of the configuration of the component describe above it is possible to use different housings 1, as is shown by FIGS. 10 and 12.

What is claimed is:

1. A device for sharpening knives, shears, or similar cutting tools, the device comprising:

a housing;

a blade-shaped carrier clastically supported on the housing; and at least one abrasive sharpening element mounted on the blade shaped carrier, wherein the abrasive sharpening element is spring loaded and is made in a strip shape.

2. The device according to claim 1, further comprising an end of the blade shaped carrier mounted to the housing via a spring.

3. The device according to claim 1, wherein the blade-shaped carrier is molded onto an end of the strip-shaped sharpening element, the blade-shaped carrier is elastically supported to the housing via a spring.

4. The device according to claim 1, wherein die blade-shaped carrier is mounted on the housing and is made as a spring element.

5. The device according to claim 1, further comprising a working surface of the sharpening clement, the working surface is made convex.

6. The device according to claim 1, wherein the several sharpening elements are elastically supported on the blade-shaped carrier, the several sharpening elements are parallel to and at a distance from each other.

7. The device according to claim 5, wherein a cross-section of the working surfaces are made corresponding to a cylindrical grinding of respective cutting edges of a cutting tool.

8. The device according to claim 1, wherein each abrasive sharpening clement is mounted on a tongue-shaped carrier and that several tongue-shaped carriers are combined into one carrier unit, which can be inserted into the housing as a component.

9. The device according to claim 8, wherein the tongue-shaped carrier is rolatably mounted on a base plate, the tongue-shaped carrier includes guides disposed at both ends of the tongue-shaped carrier.

10. The device according to claim 8, wherein the abrasive sharpening element is spring-mounted between its ends and fastened to the tongue-shaped carrier.

11. The device according to claim 10, wherein a deformation of the abrasive sharpening element is limited by a stop.

12. The device according to claim 11, wherein a stop bar is disposed in a middle on the tongue-shaped carrier.

* * * * *